US006190240B1

(12) United States Patent
Kinoshita et al.

(10) Patent No.: US 6,190,240 B1
(45) Date of Patent: Feb. 20, 2001

(54) METHOD FOR PRODUCING PAD CONDITIONER FOR SEMICONDUCTOR SUBSTRATES

(75) Inventors: Toshiya Kinoshita; Motonori Tamura, both of Kawasaki (JP)

(73) Assignee: Nippon Steel Corporation, Tokyo (JP)

( * ) Notice: Under 35 U.S.C. 154(b), the term of this patent shall be extended for 0 days.

(21) Appl. No.: 09/284,521

(22) PCT Filed: Oct. 14, 1997

(86) PCT No.: PCT/JP97/03686

§ 371 Date: Apr. 14, 1999

§ 102(e) Date: Apr. 14, 1999

(87) PCT Pub. No.: WO98/16347

PCT Pub. Date: Apr. 23, 1998

(30) Foreign Application Priority Data

| | | |
|---|---|---|
| Oct. 15, 1996 | (JP) | 8-272197 |
| Nov. 25, 1996 | (JP) | 8-313209 |
| Jan. 22, 1997 | (JP) | 9-009661 |
| Jun. 13, 1997 | (JP) | 9-156258 |
| Jun. 13, 1997 | (JP) | 9-156259 |

(51) Int. Cl.[7] ..... B24B 37/00

(52) U.S. Cl. ..... 451/56; 451/443; 451/534; 51/309

(58) Field of Search ..... 451/56, 443, 539, 451/534, 548; 51/307, 309; 106/3

(56) References Cited

U.S. PATENT DOCUMENTS

| | | | | |
|---|---|---|---|---|
| 4,992,082 | * | 2/1991 | Drawl et al. | 51/295 |
| 5,384,986 | * | 1/1995 | Hirose et al. | 451/444 |
| 5,454,752 | * | 10/1995 | Sexton et al. | 451/548 |
| 5,486,131 | * | 1/1996 | Cesna et al. | 451/56 |
| 5,522,965 | * | 6/1996 | Chisolm et al. | 156/636.1 |
| 5,707,409 | * | 1/1998 | Martin et al. | 51/295 |
| 5,785,585 | * | 7/1998 | Manfredi et al. | 451/288 |
| 5,916,010 | * | 6/1999 | Varian et al. | 451/38 |
| 5,921,856 | * | 7/1999 | Zimmer | 451/539 |

FOREIGN PATENT DOCUMENTS

| | | | |
|---|---|---|---|
| 4-5366 | * | 1/1992 | (JP) . |
| 8-71915 | * | 3/1996 | (JP) . |

* cited by examiner

*Primary Examiner*—Joseph J. Hail, III
*Assistant Examiner*—William Hong
(74) *Attorney, Agent, or Firm*—Kenyon & Kenyon

(57) ABSTRACT

A pad conditioner for semiconductor substrates for performing conditioning by slide contact with the abrasive surface of the polishing pad comprises a support member having a surface opposed to the polishing pad, a joining alloy layer covering the above surface of the support member, and a group of hard abrasive grains which are spread out and embedded in the joining alloy layer and supported by the joining alloy layer. At the contact interface between each of the hard abrasive grains and the above joining alloy, the surfaces of the hard abrasive grains are covered with either a layer of metallic carbides or a layer of metallic nitrides. Ag-base and Ag—Cu-base alloys, etc., can be used as the joining alloys.

12 Claims, 1 Drawing Sheet

METHOD FOR PRODUCING PAD CONDITIONER FOR SEMICONDUCTOR SUBSTRATES

TECHNICAL FIELD

The present invention relates to a pad conditioner used for removing clogged or foreign substances from polishing pads in the process of polishing semiconductor substrates for planarization purpose.

BACKGROUND ART

In polishing of wafers, especially conventional mechanical polishing methods which are required not to cause defects, such as mechanical strain, in the wafer while keeping a desired polishing speed, it is possible to keep such polishing speed by using larger abrasive grains and/or a higher polishing load. However, because of various defects caused by polishing, it has been impossible to ensure the compatibility between keeping a desired polishing speed and no defect. Thus there was proposed a polishing method of CMP (Chemical-Mechanical Planarization). This method permits the above compatibility by a combination of mechanical and chemical polishing actions. The CMP method is widely used in the finish polishing process of silicon wafers, which requires the compatibility between keeping a desired polishing speed and no defect in the wafers. With the increasing packing density of devices in recent years, it has become necessary, in a specific manufacturing stage of integrated circuits, to polish a wafer or the surface of a semiconductor substrate in which conductive and dielectric layers are formed on the surface of a wafer. Semiconductor substrates are polished to remove surface defects such as high protuberances and roughness. Usually, this process is performed during forming various devices and integrated circuits on the wafer. This polishing process requires the compatibility between keeping a desired polishing speed and no defect like as the finish polishing process on silicon wafers. In this polishing process for the integrated circuits, the above Chemical-Mechanical Planarization (CMP) is performed by introducing chemical slurry, which gives a higher polishing removal speed and no defect characteristic to the surface of a semiconductor. In general, the CMP process includes a step which involves holding a thin and flat semiconductor material under a controlled condition of pressure and temperature on a wet abrasive surface, and rotating the semiconductor material.

In one example of the CMP process, a polishing pad is used, which comprises polyurethane resin or the like, and a chemical slurry of around pH 9 to 12, the chemical slurry being a suspension consisting of an alkaline solution, e.g. caustic soda, ammonia, amine or the like, and silica particles. Polishing is performed by bringing a semiconductor substrate into relatively rotational contact with the polishing pad while supplying a flow of the chemical slurry onto the polishing pad. When conditioning the polishing pad, closed substances and foreign substances are removed by conditioning with utilization of an abrasive tool on which diamond grains are supported by an electrodeposited layer, conditioning while supplying a flow of water or the chemical slurry onto the polishing pad.

The conditioner used in the CMP process is essentially different from conventional cutting or grinding tools in the following points. In cutting tools, even if a small number of hard abrasive grains are lost therefrom due to release, the cutting capacity is not deteriorated in the case where other hard abrasive grains remain on the fresh surface of the tools after release of the abrasive grains. In contrast, regarding the CMP conditioner, since abrasive grains released therefrom damage the surface of the semiconductor substrate, the abrasive grains are not allowed to release from the conditioner even if the number thereof is small. Further, since the CMP conditioner is used at a low rotational speed in a wet process, it does not require such heat resistance and extreme wear resistance as required to the cutting tools. With regard to conventional tools which have a problem of release of abrasive grains, there is a cutting tool in which abrasive grains, each consisting of a comparatively coarse single grain (generally, an order of not less than 1 mm of diameter), are bonded to a metallic support material. However, the conventional cutting tools are essentially different from the conditioner used in the CMP process in the following points. In contrast to the conventional cutting tools which use coarse abrasive grains, each consisting of a comparatively coarse single grain, as stated above, with regard to the conditioner used in the CMP process, abrasive grains each having a comparatively small size (50 to 300 $\mu$m of diameter) are bonded to a base member of the conditioner so as to form a single surface layer. Further, since the CMP conditioner is used at a low rotational speed in a wet process, it does not require such heat resistance and extreme wear resistance as required to the cutting tools.

Conventionally, polishing pads have been conditioned by means of an abrasive tool on which diamond grains are supported by an electrodeposited nickel. Electrodeposition with nickel has been widely used because it can be relatively easily applied to metallic support materials. However, bonding strength between the electrodeposited nickel and diamond grains is not sufficient and releasing and breaking down of diamond grains often occurred so as to damage polishing pads and semiconductor substrates. Thus, a conditioner free from release of diamond grains have been sought.

In the case of the CMP polishing for producing a Shallow Trench Isolation (STI) structure or for an insulating film to be positioned between layers, for example, which poses a problem of decrease in the polishing speed especially due to clogging in the polishing pad, so-called the "in situ conditioning", which is carried out during polishing, is effective in comparison with a case where polishing and conditioning are separately performed. On the other hand, however, occurrence of scratches due to release of diamond grains has become more remarkable in the "in situ conditioning", thus it has been desired to establish a new "in situ dressing" method utilizing a conditioner without release of diamond grains.

DISCLOSURE OF THE INVENTION

An object of the present invention is to provide a conditioner which ensures minimum scratches, a high yield and a stable polishing speed in conditioning of polishing pads.

Under such technical background, according to the present invention, there are provided a pad conditioner for polishing pads for CMP of semiconductor substrates. A method of producing the conditioner, and a chemical-mechanical planarization method of wafers by means of the conditioner, which will be described below.

A pad conditioner is used for CMP of semiconductor substrates for performing conditioning by bringing the conditioner to slide-contact with the polishing surface of the polishing pad. A joining alloy layer covering the above surface of the conditioner supporting a group of hard abrasive grains which are embedded on the conditioner. A part of each of the hard abrasive grains is exposed to the outside of the above joining alloy layer. At the interface between the each hard abrasive grain and the above joining alloy, the surface of the hard abrasive grain is covered with a layer of either metal carbide or metal nitride.

The pad conditioner of the invention can be produced by the following method.

A first method of producing the conditioner for a polishing pad for semiconductor substrates, which comprises the steps of: preparing a support member having a surface opposed to the polishing pad, a joining alloy material comprising an active metal, and a powder of hard abrasive grains; forming a layer of the joining alloy material on the above surface of the support member; putting the powder of hard abrasive grains on the surface of the joining alloy material layer so as to uniformly distribute; inserting the support member to which the joining alloy material and the powder of hard abrasive grains are applied into a vacuum heating furnace; degassing the vacuum heating furnace to vacuum; raising the furnace temperature to the range of 650° C. to 1200° C. and holding it for a predetermined time to cause the respective hard abrasive grains to partially enter into the joining alloy material layer in a molten state; and lowering the furnace temperature to room temperature.

A second method of producing the pad conditioner for semiconductor substrates, which comprises the steps of: preparing a support member having a surface opposed to the polishing pad, and a powder of hard abrasive grains; preparing a powder of hard abrasive grains on each of which any one of the films selected from the group consisting of an active metal film, an active metal carbide film and an active metal nitride film is formed; forming a layer of a joining alloy material on the above surface of the support member; putting the powder of hard abrasive grains on the surface of the joining alloy material layer so as to uniformly distribute; and inserting the support member to which the joining alloy material and the powder of hard abrasive grains are applied into a vacuum heating furnace; degassing the vacuum heating furnace to vacuum; raising the furnace temperature to the range of 650° C. to 1200° C. and holding it for a predetermined time cause the respective hard abrasive grains to partially enter into the joining alloy material layer in a molten state; and lowering the furnace temperature to room temperature.

Ag-base and Ag—Cu-base alloys, etc., can be used as the joining alloy. The joining alloys preferably may have 650° to 1200° C. melting point. The joining alloy material can be used in the form of foil, powder, etc. When a joining alloy contains 0.4 to 20 wt. % of active metal, in particular, at least one selected from the group consisting of titanium, chromium and zirconium, hard abrasive grains which are not subjected to any preparatory surface treatment are frequently used as the raw material. When a joining alloy does not contain active metals, it is necessary to subject hard abrasive grains as the raw material to preparatory surface treatment. As the preparatory surface treatment it is recommendable to apply a film composed of the above active metals or a film composed of carbides or nitrides of the above active metals to the surfaces of the hard abrasive grains as the material by the ion plating method, vacuum deposition method, sputtering method, CVD method, etc. The range of film thickness is preferably from 0.1 to 10 $\mu$m. Diamond grains, cubic boron nitride (BN) grains, boron carbide ($B_4C$) grains or silicon carbide (SiC) grains are preferable as hard abrasive grains. Sizes of grains preferably range from 50 $\mu$m to 300 $\mu$m. The average grain intervals of the grains applied to the conditioner are preferably 0.1 to 10 times the grain size and more preferably 0.3 to 5 times the grain size.

Stainless steels of high resistance are preferable as the material for the above support member. The use of ferritic stainless steels, in particular, is favorable for handling conditioners by making use of magnetic properties.

Furthermore, according to the pad conditioner of the present invention, the releasing of hard abrasive grains hardly occur easily during conditioning. Therefore, a decrease in the wafer polishing speed due to the loading of a polishing pad can be effectively improved by performing conditioning by means of the above conditioner as a simultaneous and parallel operation during the planarization, by chemical-mechanical polishing, of the surface of a semiconductor substrate in which a semiconductor device composed of conductive and dielectric layers is formed on the surface of a wafer.

BEST MODE FOR CARRYING OUT THE INVENTION

Figure 1:
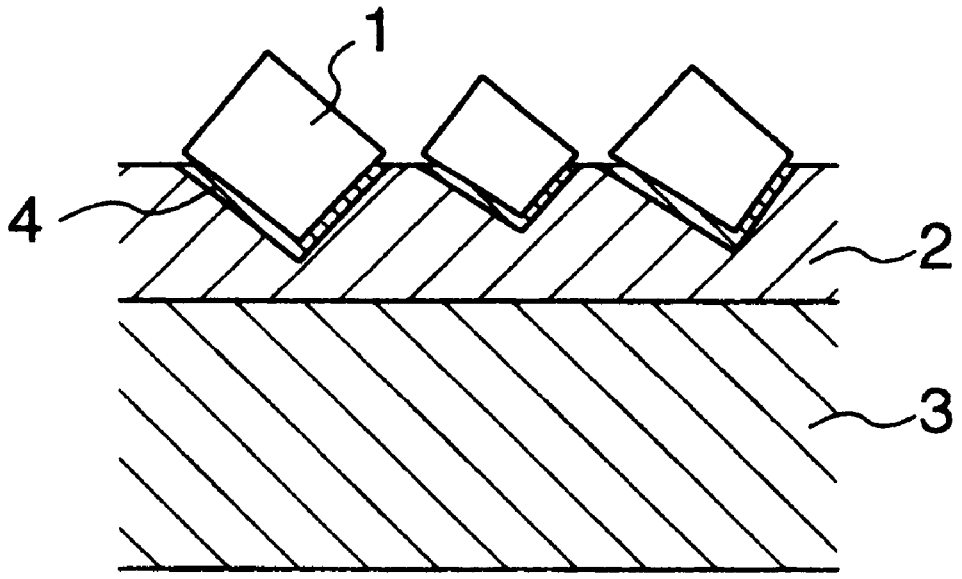
FIG. 1 is a schematic sectional view of a pad conditioner of one embodiment of the present invention.

The pad conditioner for semiconductor substrates fabricated according to the present invention can minimize scratches caused by released hard grain grains. As a result, it is possible to produce semiconductor substrates and semiconductors with high working accuracy and high yield.

In bonding hard abrasive grains, such as diamond grains, cubic boron nitride (BN) grains, boron carbide ($B_4C$) grains and silicon carbide (SiC) grains, with a brazing metal, bonding strength is substantially increased by forming a layer of metallic carbides or a layer of metallic nitrides of at least one selected from active metals, such as titanium, chromium and zirconium, at the interface between each of the hard abrasive grains and the brazing metal. The formation of the layer of metallic carbides or metallic nitrides at the interface was ascertained by means of the energy dispersion type X-ray spectroscopy and EPMA (electron probe microanalyser) subordinate to a scanning electron microscope. The present inventors ascertained that with the use of an alloy metal containing 0.5 to 20 wt. % of at least one selected from active metals, such as titanium, chromium and zirconium, as the joining alloy material, a layer of carbides or nitrides of the relevant metal is formed at the interface between each of the hard abrasive grains and the joining alloy. Furthermore, they ascertained that with the use of hard abrasive grains having a film composed of at least one selected from active metals, such as titanium, zirconium and chromium, or hard abrasive grains having a film composed of at least one selected from carbides or nitrides of active metals, such as titanium, zirconium and chromium, a layer of metallic carbides or a layer of metallic nitrides is formed at the interface between each of the hard abrasive grains and the joining alloy.

The reason why at least one selected from active metals, such as titanium, chromium and zirconium, is added to the joining alloy in amounts of 0.5 to 20 wt. % is that a layer of carbides or nitrides of the relevant metal is not formed at the interface between each of the hard abrasive grains and the joining alloy material when the content is not lower than 0.5 wt. % and that a further increase in bonding strength cannot be expected even when the content exceeds 20 wt. %.

The reason why the joining alloy material is an alloy with a melting point between 650° and 1200° C. is that sufficient bonding strength cannot be obtained with a joining alloy with a melting point of under 650° C. and that the deterioration of hard abrasive grains or support members occurs at a temperature exceeding 1200° C., which is undesirable. The thickness of the joining alloy material is preferably 0.2 to 1.5 times the size of abrasive grains. The bonding strength between the abrasive grains and the joining alloy decreases when joining alloy material is too thin, and exfoliation of brazing material from the support member is apt to occur when the joining alloy material is too thick.

It is necessary that not less than 40% of the surface area of hard abrasive grains be covered with the brazing material, and preferably not less than 70% of the surface area is covered with the brazing material.

The thickness of the film covering hard abrasive grains, which is composed of at least one selected from active metals, such as titanium, chromium and zirconium, or carbides or nitrides of active metals, should be from 0.1 to 10 μm. This is because hard abrasive grains require a film of not less than 0.1 μm in thickness in order to ensure the formation of a layer of metallic carbides or metallic nitrides at the interface and because film layer thicknesses of at least 10 μm produce a sufficient effect on an increase in the bonding strength by the formation of a layer of metallic carbides or metallic nitrides at the interface.

The size of hard abrasive grains preferably ranges from 50 μm to 300 μm. Sufficient polishing speeds cannot be obtained with hard abrasive grains of under 50 μm and can be obtained when the size of hard abrasive grains is within the range from 50 to 300 μm. When hard abrasive grains are fine grains of under 50 μm, they have a tendency toward coalescence and are apt to be released when they coalesce to form clusters, causing scratches. When hard abrasive grains are coarse grains exceeding 300 μm, they have a tendency toward releasing because of high stress concentration during polishing.

The support member is preferably made of a ferritic stainless steel and hard abrasive grains are preferably joined to only one side of the support member. Ferritic stainless steels are easy to work. Furthermore, because the other side of the support member is not joined, the support member can be attached and detached, for example, by means of a magnet, thus contributing greatly to an improvement in the efficiency of work.

According to the conditioner of the present invention, the releasing of hard abrasive grains does not occur easily during conditioning. Therefore, a decrease in the wafer polishing speed due to the loading of a polishing pad can be effectively suppressed by performing conditioning by means of the above conditioner as a simultaneous and parallel operation during the planarization, by chemical-mechanical polishing, of the surface of a semiconductor substrate in which a semiconductor device composed of conductive and dielectric layers is formed on the surface of a wafer.

FIG. 1 schematically shows a conditioner of one embodiment of the present invention. The surface of a support member 3 is covered with a joining alloy layer 2 and hard abrasive grains 1 are supported by the joining alloy layer 2. Each grain 1 is supported in such a manner that the lower part of the grain is embedded in the joining alloy layer 2. A layer of metallic carbides or metallic nitrides 4 is present at the interface between each grain 1 and the joining alloy, and the grain 1 is firmly held in the joining alloy layer by the presence of the interface layer.

EXAMPLE 1

Pad conditioners of the present invention were fabricated by holding hard abrasive grains of diamond, cubic boron nitride, boron carbide, silicon carbide, etc. having a size as shown in Sample 2 to Sample 17 of Table 1 in a vacuum of $10^{-5}$ Torr at the temperatures shown in Table 1 for 30 minutes and brazing them in a single layer to a substrate made of a ferritic stainless steel with the aid of the joining alloy materials shown in Table 1. A polishing experiment on 400 semiconductor wafers was conducted by means of the conditioners thus obtained. Conditioning was performed for two minutes after each polishing operation. After the polishing of the 400 semiconductor wafers, an investigation was made as to the number of wafers in which scratches occurred due to hard abrasive grains which were released. Furthermore, the removal rate after 2 hours and 20 hours of polishing were investigated by means of the polishing pad used. It took about 20 hours to polish the 400 wafers. The result of the experiment is shown in Table 1. Surface defects of wafers and the size of abrasive grains were observed under an electron microscope.

In the pad conditioners according to the present invention, the occurrence of scratches on the wafer surface decreased substantially in comparison with the conventional conditioner and a decrease in the removal rate was also improved. The production of semiconductor substrates with a high throughput and a high yield could be realized by the use of the conditioners of the present invention.

EXAMPLE 2

Diamond grains and cubic boron nitride with an average size of 150 μm were separately coated with titanium with a thickness of 2 μm and chromium with a thickness of 2 μm by the ion plating method. Four types of conditioners were fabricated by performing brazing in a vacuum of $10^{-5}$ Torr at 850° C. with the use of the diamond coated with titanium, cubic boron nitride coated with titanium, cubic boron nitride coated with chromium, and cubic boron nitride coated with chromium.

A polishing experiment on 400 semiconductor wafers was conducted by means of the above four types of conditioners of the present invention and conventional Ni-electrodeposited conditioner. Conditioning was performed for two minutes after each polishing operation. After the polishing of the 400 semiconductor wafers, an investigation was made as to the number of wafers in which scratches occurred due to hard abrasive grains which were released. Furthermore, the removal rate after each 5 hours of polishing was investigated. It took about 20 hours to polish the 400 wafers. Surface defects of wafers and the size of abrasive grains were observed under an electron microscope.

In the conditioners according to the present invention, the occurrence of scratches on the wafer surface decreased substantially in comparison with the conventional conditioner. With neither of the above two types of conditioners of the present invention scratches occurred in wafers, whereas scratches occurred in 9 wafers when the conventional conditioner was used. A decrease in the removal rate after the polishing of the 400 wafers was not observed in the invented products. The production of semiconductor substrates with a high throughput and a high yield could be realized by the use of the conditioners of the present invention.

EXAMPLE 3

Diamond grains and cubic boron nitride with an average size of 150 μm were coated with titanium carbide in a thickness of 2 μm and chromium in a thickness of 2 μm by the ion plating method. Two types of conditioners were fabricated by performing brazing in a vacuum of $10^{-5}$ Torr at 850° C. with the use of the diamond coated with titanium carbide and cubic boron nitride coated with titanium carbide.

A polishing experiment on 400 semiconductor wafers was conducted by means of the above two types of conditioners of the present invention and conventional Ni-electrodeposited conditioner. Conditioning was performed for two minutes after each polishing operation. After the polishing of the 400 semiconductor wafers, an investigation was made as to the number of wafers in which scratches occurred due to hard abrasive grains which were released. Furthermore, the removal rate after polishing for a predetermined time was investigated. It took about 20 hours to polish the 400 wafers. Surface defects of wafers and the size of abrasive grains were observed under an electron microscope.

In the conditioners according to the present invention, the occurrence of scratches on the wafer surface decreased substantially in comparison with the conventional conditioner. Scratches did not occur in wafers with any of the above conditioners of the present invention, whereas scratches occurred in 9 wafers when the conventional conditioner was used. A decrease in the removal rate after the polishing of the 400 wafers was not observed in the invented products. The production of semiconductor substrates with a high throughput and a high yield could be realized by the use of the conditioners of the present invention.

EXAMPLE 4

Pad conditioners of the present invention were fabricated by holding hard abrasive grains having a size as shown in Sample 2 to Sample 10 of Table 2 in a vacuum of $10^{-5}$ Torr at the temperatures shown in Table 2 for 30 minutes and brazing them in a single layer to a substrate made of a ferritic stainless steel with the aid of the joining alloy materials shown in Table 2. A polishing experiment on 400 silicon wafers was conducted by means of the conventional Ni-electrodeposited conditioner and invented conditioners. Conditioning was performed for two minutes each after 10 polishing operations. After the polishing of the 400 silicon wafers, an investigation was made as to the number of wafers in which scratches occurred due to hard abrasive grains which were released. Furthermore, the removal rate after 3 hours and 30 hours of polishing were investigated by means of the polishing pad used. It took about 30 hours to polish the 400 wafers. The result of the experiment is shown in Table 2. Surface defects of wafers and the size of abrasive grains were observed under an electron microscope.

In the conditioners according to the present invention, the occurrence of scratches on the wafer surface decreased substantially in comparison with the conventional conditioner and a decrease in the removal rate did not occur. The production of silicon wafers with a high throughput and a high yield could be realized by the use of the conditioners of the present invention.

EXAMPLE 5

Pad conditioners of the present invention were fabricated by holding diamond having an average grain size of 150 $\mu$m in a vacuum of $10^{-5}$ Torr at 850° C. for 30 minutes and brazing it in a single layer to a substrate made of a ferritic stainless steel with the aid of a joining alloy material having the composition Ag—Cu-2 wt. % Ti.

For the above conditioners of the present invention and conventional Ni-electrodeposited conditioner, a polishing experiment on 400 semiconductor wafers with oxide film was conducted. Conditioning was performed in situ during polishing for 2 minutes after each polishing operation. After the polishing of the 400 semiconductor wafers, an investigation was made as to the number of wafers in which scratches occurred due to hard abrasive grains which were released. The removal rate after the polishing of 40 and 400 wafers was investigated by means of the polishing pad used. Surface defects of wafers and the size of abrasive grains were observed under an electron microscope.

In the conditioners according to the present invention, the occurrence of scratches on the wafer surface decreased substantially in comparison with the conventional conditioner. Scratches did not occur in wafers with any of the above conditioners of the present invention, whereas scratches occurred in 13 wafers when the conventional conditioner was used. A decrease in the removal rate after the polishing of the 400 wafers was not observed in the invented products. The use of the conditioners of the present invention has permitted the application of CMP polishing techniques for performing in situ conditioning, which realizes the production of semiconductor substrates with a high throughput and a high yield.

Industrial Applicability

The pad conditioner of the present invention is used for the conditioning of polishing pads used for the planarization polishing of semiconductor substrates, namely, for the removal of foreign matter that has entered the fine pores of a polishing pad having a large number of such pores and has accumulated in them.

TABLE 1

| Conditioner No. | 1 Comparative example | 2 Invention example | 3 Invention example | 4 Invention example | 5 Invention example | 6 Invention example | 7 Invention example | 8 Invention example |
|---|---|---|---|---|---|---|---|---|
| Joining alloy material (Melting point ° C.) | Ni (1453) | Ag-cu-3 wt % Zr (800) | Ag-Cu-5 wt % Cr (820) | Ag-cu-2 wt % Ti (790) | Ni-7 wt % Cr-B-Si-Fe-C (1000) | Ag-Cu-Ni-4 wt % Ti (890) | Ag-Cu-Sn-Ni-10 wt % Zr (830) | Ag-Cu-Sn-Ni-15 wt % Ti (910) |
| Kind of abrasive grains | Diamond | Diamond | Diamond | Diamond | Diamond | Diamond | Diamond | Diamond |
| Size of abrasive grain ($\mu$m) | 130–170 | 150–210 | 140–170 | 150–190 | 130–160 | 250–300 | 130–170 | 60–90 |

TABLE 1-continued

| | | | | | | | | |
|---|---|---|---|---|---|---|---|---|
| Joining temperature (° C.) | Electro-deposition | 850 | 850 | 850 | 1050 | 950 | 850 | 950 |
| Number of wafers in which scratches occurred after polishing of 400 wafers | 9 | 0 | 0 | 0 | 0 | 0 | 0 | 0 |
| Removal rate after 2 hours (μm/min) | 0.15 | 0.15 | 0.15 | 0.15 | 0.15 | 0.15 | 0.15 | 0.15 |
| Removal rate after 20 hours (μm/min) | 0.14 | 0.15 | 0.15 | 0.15 | 0.15 | 0.15 | 0.15 | 0.15 |

| Conditioner No. | 9 Invention example | 10 Invention example | 11 Invention example | 12 Invention example | 13 Invention example | 14 Invention example | 15 Invention example | 16 Invention example | 17 Invention example |
|---|---|---|---|---|---|---|---|---|---|
| Joining alloy material | Ag-Cu-Li-2 wt % Ti | Ag-Cu-Li-10 wt % Cr | Ag-Cu-5 wt % Cr | Ag-Cu-2 wt % Ti | Ag-Cu-Li-2 wt % Ti | Ag-Cu-3 wt % Zr | Ag-Cu-Sn-Ni-15 wt % Ti | Ni-B-Si-7 wt % Cr-C-Fe | Ag-Cu-Ni-4 wt % Ti |
| (Melting point ° C.) | (790) | (850) | (820) | (790) | (790) | (800) | (910) | (1000) | (890) |
| Kind of abrasive grains | Diamond | Diamond | Cubic boron nitride | Cubic boron nitride | Boron carbide | Cubic boron nitride | Silicon carbide | Cubic boron nitride | Boron carbide |
| Size of abrasive grain (μm) | 200–300 | 140–180 | 130–170 | 150–180 | 230–300 | 130–170 | 130–180 | 230–300 | 130–170 |
| Joining temperature (° C.) | 850 | 900 | 850 | 850 | 850 | 850 | 1000 | 1050 | 950 |
| Number of wafers in which scratches occurred after polishing of 400 wafers | 0 | 0 | 0 | 0 | 0 | 0 | 0 | 0 | 0 |
| Removal rate after 2 hours (μm/min) | 0.15 | 0.15 | 0.15 | 0.15 | 0.15 | 0.15 | 0.15 | 0.15 | 0.15 |
| Removal rate after 20 hours (μm/min) | 0.15 | 0.15 | 0.15 | 0.15 | 0.15 | 0.15 | 0.15 | 0.15 | 0.15 |

TABLE 2

| Conditioner No. | 1 Comparative example | 2 Invention example | 3 Invention example | 4 Invention example | 5 Invention example | 6 Invention example | 7 Invention example | 8 Invention example | 9 Invention example | 10 Invention example |
|---|---|---|---|---|---|---|---|---|---|---|
| Joining alloy material | Ni | Ag-cu-3 wt % Zr | Ag-Cu-5 wt % Cr | Ag-cu-2 wt % Ti | Ni-7 wt % Cr-B-Si-Fe-C | Ag-Cu-5 wt % Cr | Ag-Cu-2 wt % Ti | Ag-Cu-Li-2 wt % Ti | Ag-Cu-3 wt % Zr | Ag-Cu-Sn-Ni-15 wt % Ti |
| (Melting point ° C.) | (1453) | (800) | (820) | (790) | (1000) | (820) | (790) | (790) | (800) | (910) |
| Kind of abrasive grains | Diamond | Diamond | Diamond | Diamond | Diamond | Cubic boron nitride | Cubic boron nitride | Boron carbide | Cubic boron nitride | Silicon carbide |
| Size of abrasive grain (μm) | 130–170 | 150–210 | 140–170 | 150–190 | 130–160 | 130–170 | 150–180 | 230–300 | 130–170 | 130–180 |
| Joining temperature (° C.) | Electro-deposition | 850 | 850 | 850 | 1050 | 850 | 850 | 850 | 850 | 1000 |

TABLE 2-continued

| Conditioner No. | 1 Comparative example | 2 Invention example | 3 Invention example | 4 Invention example | 5 Invention example | 6 Invention example | 7 Invention example | 8 Invention example | 9 Invention example | 10 Invention example |
|---|---|---|---|---|---|---|---|---|---|---|
| Number of wafers in which scratches occurred after polishing of 400 wafers | 4 | 0 | 0 | 0 | 0 | 0 | 0 | 0 | 0 | 0 |
| Removal rate after 2 hours (μm/min) | 0.3 | 0.3 | 0.3 | 0.3 | 0.3 | 0.3 | 0.3 | 0.3 | 0.3 | 0.3 |
| Removal rate after 20 hours (μ/min) | 0.3 | 0.3 | 0.3 | 0.3 | 0.3 | 0.3 | 0.3 | 0.3 | 0.3 | 0.3 |

What is claimed is:

1. A method of producing a pad conditioner for a polishing pad for semiconductor substrates for performing conditioning by bringing the conditioner into slide-contact with the polishing surface of the polishing pad, which comprises the steps of:

preparing a support member having a surface opposed to said polishing pad, a joining alloy material comprising an active metal, and a powder of hard abrasive grains;

forming a layer of said joining alloy material on the surface of said support member opposed to said polishing pad;

putting said powder of hard abrasive grains on the surface of said joining alloy material layer so as to uniformly distribute;

inserting said support member to which said joining alloy material and said powder of hard abrasive grains are applied into a vacuum heating furnace;

degassing said vacuum heating furnace to vacuum;

raising the furnace temperature to the range of 650° C. to 1200° C. and holding it for a predetermined time to cause said respective hard abrasive grains to partially enter into said joining alloy material layer in a molten state; and lowering the furnace temperature to room temperature.

2. A method of producing a pad conditioner according to claim 1, wherein the step of forming a layer of a joining alloy material on the surface of said support member opposed to said polishing pad comprises putting said joining alloy material on the surface of said support opposed to said polishing pad, with the surface of said support member opposed to said polishing pad facing upwards almost in a horizontal position.

3. A method of producing a pad conditioner according to claim 1, wherein the melting point of said joining alloy is in the range of 650° C. to 1200° C.

4. A method of producing a pad conditioner according to claim 1, wherein said joining alloy comprises 0.5 to 20 wt. % of an active metal.

5. A method of producing a pad conditioner according to claim 4, wherein said active metal is at least one selected from the group consisting of titanium, chromium and zirconium.

6. A method of producing a pad conditioner according to claim 1, wherein said joining alloy material is in foil form.

7. A method of producing a pad conditioner according to claim 1, wherein the diameter of each of said hard abrasive grains is in the range of 50 μm to 300 μm.

8. A method of producing a pad conditioner for semiconductor substrates for performing conditioning by bringing the conditioner into slide-contact with the polishing surface of the polishing pad, comprising the steps of:

preparing a support member having a surface opposed to said polishing pad, and a joining alloy material;

preparing a powder composed of hard abrasive grains in which any one of the films selected from the group consisting of an active metal film, a film of an active-metal carbide, and a film of an active-metal nitride is applied to the surface of each grain;

forming a layer of said joining alloy material on the above surface of said support member opposed to said polishing pad;

putting said powder of hard abrasive grains on the surface of said joining alloy material layer so as to uniformly distribute;

inserting said support member to which said joining alloy material and said powder of hard abrasive grains are applied into a vacuum heating furnace;

degassing said vacuum heating furnace to vacuum;

raising the furnace temperature to the range of 650° C. to 1200° C. and holding it for a predetermined time;

causing said respective hard abrasive grains to partially enter into said joining alloy material layer in a molten state; and lowering the furnace temperature to room temperature.

9. A method of producing a pad conditioner according to claim 8, wherein the melting point of said joining alloy is in the range of 650° C. to 1200° C.

10. A method of producing a pad conditioner according to claim 8, wherein a film covering said respective hard abrasive grains is formed on the surface of grain by the vapor phase method and has a thickness of 0.1 to 10 μm.

11. A method of producing a pad according to claim 8, wherein an active metal which forms at least one film, covering said hard abrasive grains, selected from the group consisting of an active metal film, an active metal carbide film and an active metal nitride film, is at least one selected from the group consisting of titanium, chromium and zirconium.

12. A method of producing a pad according to claim 8, wherein the diameter of each of said hard abrasive grains is in the range of 50 μm to 300 μm.

* * * * *